United States Patent [19]

Kleinberg et al.

[11] Patent Number: 4,543,857

[45] Date of Patent: Oct. 1, 1985

[54] SURGICAL INSTRUMENT AND METHOD OF MAKING SAME

[75] Inventors: Larry K. Kleinberg, Burbank; Don S. Evans, Pasadena, both of Calif.

[73] Assignee: Urban Engineering Co., Inc., Burbank, Calif.

[21] Appl. No.: 559,387

[22] Filed: Dec. 9, 1983

[51] Int. Cl.[4] ..... B24B 1/00; B24B 3/00

[52] U.S. Cl. ..... 76/101 R; 76/104 R; 51/218 T; 51/220; 51/227 H; 30/133; 128/305

[58] Field of Search ..... 228/162, 199; 29/445; 76/101 R, 104 R; 269/26, 287; 128/305; 51/218 T, 219 PC, 220, 221 BS, 227 R, 227 H, 277, 288, 323, 281 C; 30/228, 279, 133

[56] References Cited

U.S. PATENT DOCUMENTS

| | | | |
|---|---|---|---|
| 2,124,093 | 7/1938 | Wells | 51/219 PC |
| 2,299,126 | 10/1942 | Cantley | 51/220 |
| 2,402,306 | 6/1946 | Turkel | 51/227 H |
| 2,663,976 | 12/1953 | Jacoby, Jr. | 51/227 H |
| 2,720,731 | 10/1955 | Staat | 51/225 |
| 2,972,779 | 2/1961 | Cowley | 51/323 |
| 3,459,187 | 8/1969 | Pallotta | 76/101 R |
| 3,656,264 | 4/1972 | Mackey et al. | 51/288 |
| 4,001,975 | 1/1977 | Bernard et al. | 51/219 PC |
| 4,016,685 | 4/1977 | Moores et al. | 51/227 |
| 4,272,927 | 6/1981 | Myers et al. | 76/101 R |
| 4,466,265 | 8/1984 | Wessel | 76/101 R |

*Primary Examiner*—Nicholas P. Godici
*Assistant Examiner*—M. Jordan
*Attorney, Agent, or Firm*—Frank L. Zugelter

[57] ABSTRACT

A surgical instrument, with method and apparata for making same. A pair of coaxial tubular members include cooperating oval openings the formations of which are developed by the apparata and method. One apparatus comprises a fixture for supporting the inner or blade member in a spindle having a follower, and a cam assembly and registry means for mounting to the fixture. The cam assembly is mounted to the fixture and through cooperative action with the follower directs movement of blade member and spindle during grinding formation of a blade's thickness including a positive cutting angle across its wall. The registry means comprises a body mountable to the cam assembly and having a pin which properly seats an initially formed opening in the blade member exteriorly of the cam assembly for subsequent grinding thereon. A second apparatus provides for the initial formation of both openings after which the first apparatus operates to finish the blade member's body formation for its opening. The methods of forming these openings also are unique.

19 Claims, 40 Drawing Figures

FIG. 1
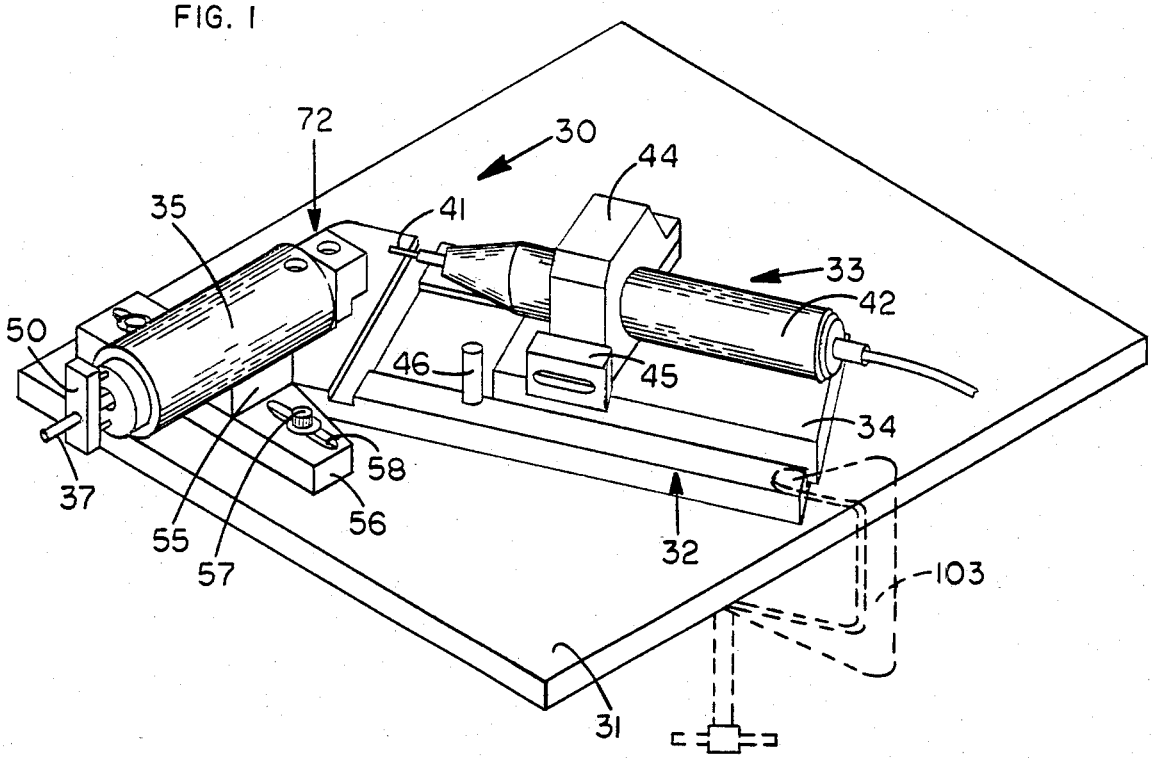
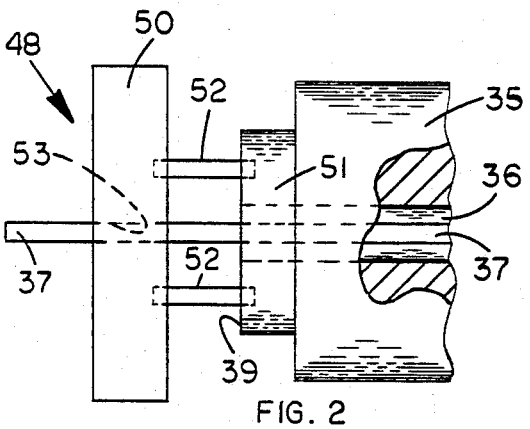
FIG. 2
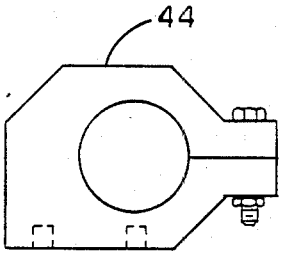
FIG. 3

FIG. 36
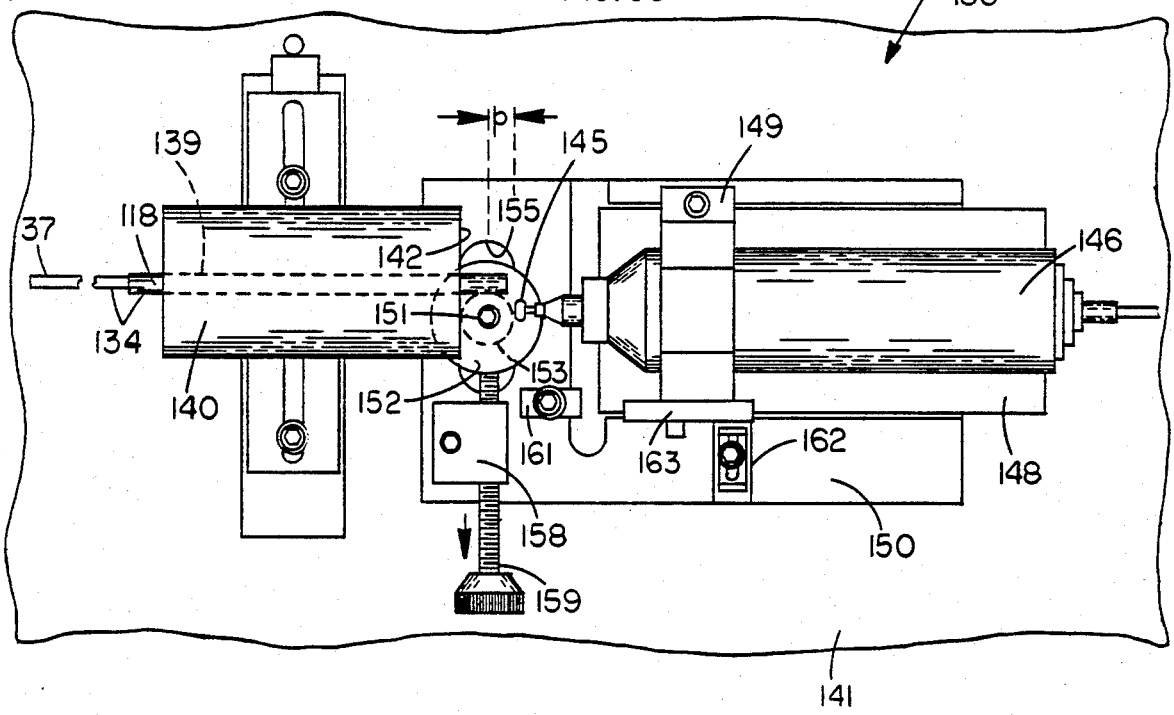
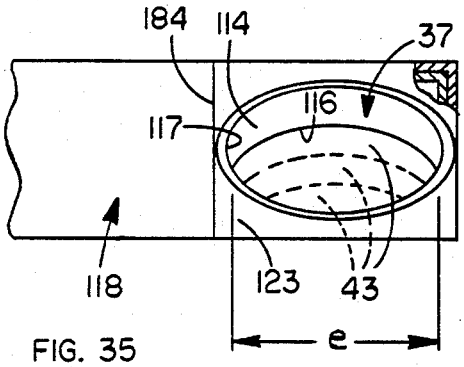
FIG. 35
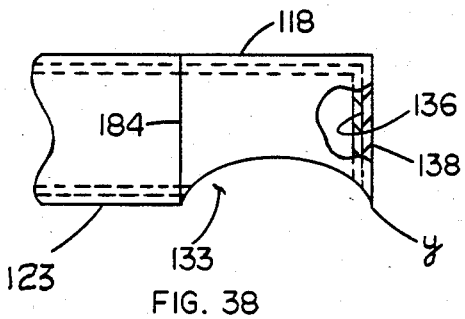
FIG. 38
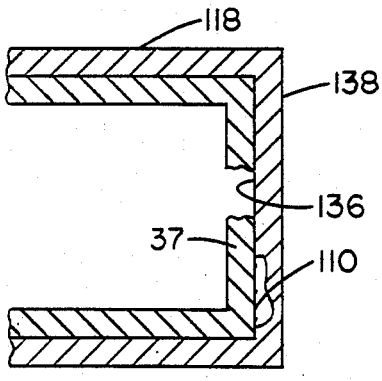
FIG. 37
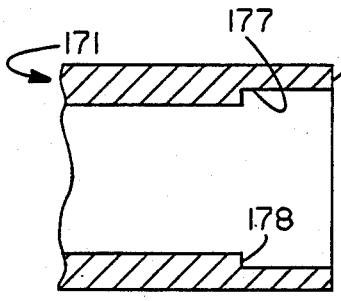
FIG. 39
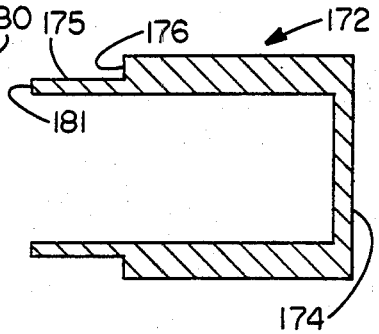
FIG. 40

SURGICAL INSTRUMENT AND METHOD OF MAKING SAME

TECHNICAL FIELD

This invention relates to cutting devices, and in particular to a product, process and apparatus for effecting effacacious cutting edges in a tubular instrument, adapted for surgical use, and by which undesired substances, tissues, or the like are quickly and efficiently removed in delicate surgical operation.

BACKGROUND ART

U.S. Pat. No. 3,618,611 discloses a vacuum rotary dissector on which the invention of the instant nature is utilized. Various apparata in the surgical arts, which remove undesired substances from various parts of the human or animal body, utilizing various cutting elements, including tubular members, are disclosed in U.S. Pat. Nos. 4,274,414; 3,844,272, 3,732,858. Other prior art teachings showing similar instruments are found in U.S. Pat. Nos. 737,293; 1,493,240; 1,585,934; 1,663,761; 2,369,925; 4,203,444; and 3,734,099.

PROBLEMS IN THE ART

Heretofore, the grinding of the cutting edges for a surgical blade member required a form of hand grinding, i.e., a motorized hand drill would be manipulated upon edges formed as an opening in the blade member, so that the finished edges would efficiently cooperate with complementing cutting edges cut in an exteriorly mounted sheath. This work on the interiorly mounted tubular member was tedious and time consuming. Painstaking efforts were always required to obtain a positive angle of cutting on the cutting edge for the blade member.

Particularly, in the grinding of the thickness of a tubular wall's cutting edge forming its opening , it is difficult to manually manupulate a hand burr within an opening in a tubular wall of relatively small dimensions, to effect as much as possible a positive cutting angle across the thickness of the wall at its opening.

The nature and magnitude of the problem in generating a positive cutting angle across the thickness of a tubular wall is made clear and understandable by knowing that the dimension of the tubing is 0.134 inch for its outer surface diameter, and in the nature of 0.111 inch for its inner surface diameter. Thus, with a 0.0115 inch wall thickness to work with in generating a positive cutting angle, present manufacturing processes to date have not produced an efficient, mechanical or successful operation in the manufacture of such a small dimensioned instrument, particularly required in surgical operations such as on the meniscus of the knee.

The apparatus and method of this invention achieve the result of a consistently uniform positive cutting angle across the thickness of a tubular wall having a body formation forming a closed opening.

DISCLOSURE OF THE INVENTION

Summary

An object of this invention is to provide an efficacious rotary, tubular cutting instrument, and particularly as it relates or is adapted to surgery.

Another object of this invention is to provide a novel method and apparata to produce an efficient and effacacious rotary cutting instrument.

A further object of this invention is to provide a consistent positive angle of attack for a cutting edge forming an opening in a tubular blade member.

A still further object of the invention is to eliminate time-consuming hand grinding operations on the thickness of a tubular wall's cutting edge forming an opening, thereby reducing time, labor and expense in the manufacture of a rotary cutting instrument.

An object of this invention is to produce a clean scissor-like action in the cooperation of the cutting edges of a rotating blade member and its sheath.

Another object of this invention is to prevent rotation of tissue, cartilage or other substances pulled in to a blade member itself through its opening by providing a clean, scissors-like action upon such substances at substantially the moment of their entries into the opening of the blade member as it and its cutting edge is rotating relative to the sheath.

A still further object of the invention is to provide novel apparata by which the method of producing the blade, though not limited thereto, may be carried out.

Another object of this invention is to provide a positive cutting angle across the thickness of a tubular blade along its cutting edge of the opening and by which sufficient wall thickness is retained against the cutting action on hard-like body tissues and substances so that the edge won't break down during such cutting action, and still provide an effective scissors-like cutting action.

Another object of the invention is to prevent substances cut by the blade from jamming in between the walls of the blade member and its sheath.

Another object of this invention is to provide a unique and novel method for producing a positive cutting angle across the thickness of a tubular member along its endless edge forming a cutting opening and which edge in cooperation with a sheath's edge produce a scissors-like action on material being severed.

A further object of this invention is to provide a positive cutting angle on opposing lengths of an endless edge forming a compound oval opening so that the blade in actual operation can be reversed in its rotation and still provide effacacious cutting action between blade and sheath.

These and other objects of the invention will become more apparent and appreciated upon a complete and full reading of the following description, appended claims thereto, and the accompanying drawing comprising 7 sheets of 40 FIGURES.

BRIEF DESCRIPTION OF THE DRAWING

FIG. 1 is a general perspective view of a jig set-up for carrying out the invention.

FIG. 2 is a fragmentary elevational view of a portion of the jig set-up of FIG. 1.

FIG. 3 is an elevational view of a clamping element for a motor assembly in the jig set-up of FIG. 1.

FIG. 35 [sheet 7] is a view of progressive stages of the relationship of the complementing openings of blade and sheath as the former rotates relative to the latter.

FIG. 36 is a plan view of a jig set-up for forming initially the compound oval openings in both blade and sheath members.

FIG. 37 is a fragmentary sectional-view of the relationship of the end walls of blade and sheath during the process of initially forming their openings and in finished assembly.

FIG. 38 is a view of the openings of blade and sheath after forming initially such openings, prior to forming a positive cutting angle on the blade's cutting edges at its opening(and also as in finished assembly).

FIGS. 39 and 40 are cross-sectional views of two tubular members in process of being made into one element, either a blade member or its sheath, and prior to combining complementing blade and sheath members for forming initial openings therein.

DESCRIPTION OF THE PREFERRED EMBODIMENT

Figure 4:
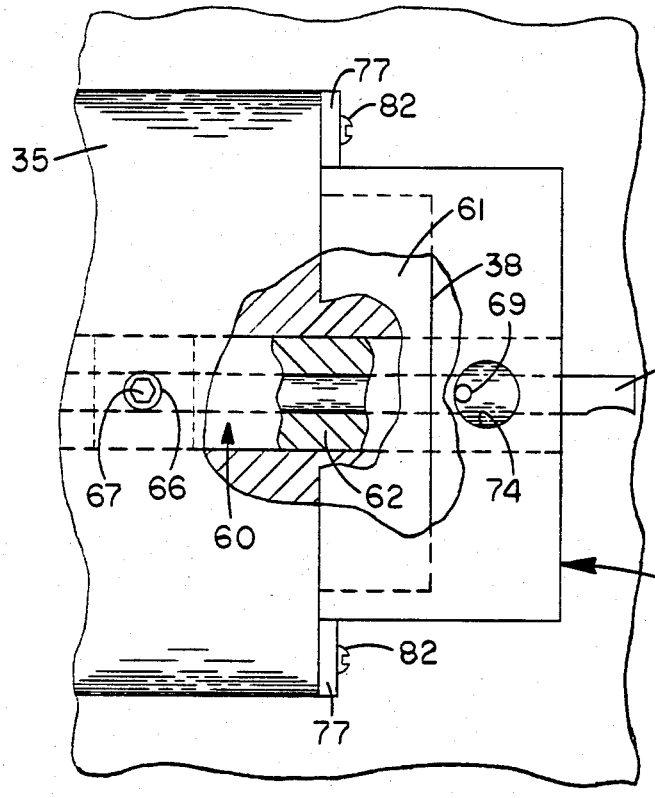
FIG. 4 is a fragmentary plan view of the front end of a blade holder in the jig set-up of FIG. 1.

Referring now to the FIGURES of the drawing wherein reference characters therein correspond to like numerals hereinafter, FIG. 1 shows a jig 30 which is set-up and suitably mounted on a table plate 31 stationarily positioned on a worktable (not shown) at which an operator is stationed to perform acts in the course of carrying out the invention. Jig 30 comprises a rigid flat base member 32 pivotable and slidably mounted upon table plate 31, a motor assembly 33 securely mounted on a carriage 34 reciprocatingly mounted along the length of base member 32, and a blade holder-fixture 35 securely mounted to table plate 31 in operable position relative to motor assembly 33. Fixture 35 comprises an elongated cylindrical member having an axially aligned bore 36, FIG. 2, in which a tubular member or blade 37 is mounted, the bore 35 terminating at a frontal end face 38, FIG. 5, for the fixture 35 and at a rear end face 39, FIG. 2, for such fixture. Base member 32 is generally angularly positioned relative to the axis of bore 36, FIGS. 1, 7, for carrying out the invention in this embodiment, and is pivotable as by a bolt 40 having its pivot axis intersecting an extension of the axis for bore 36. The reciprocating assembly 33 is mounted suitably, FIG. 1, such as by (not shown) ball bearings, in races provided in base member 32 and carriage 34.

Figure 5:
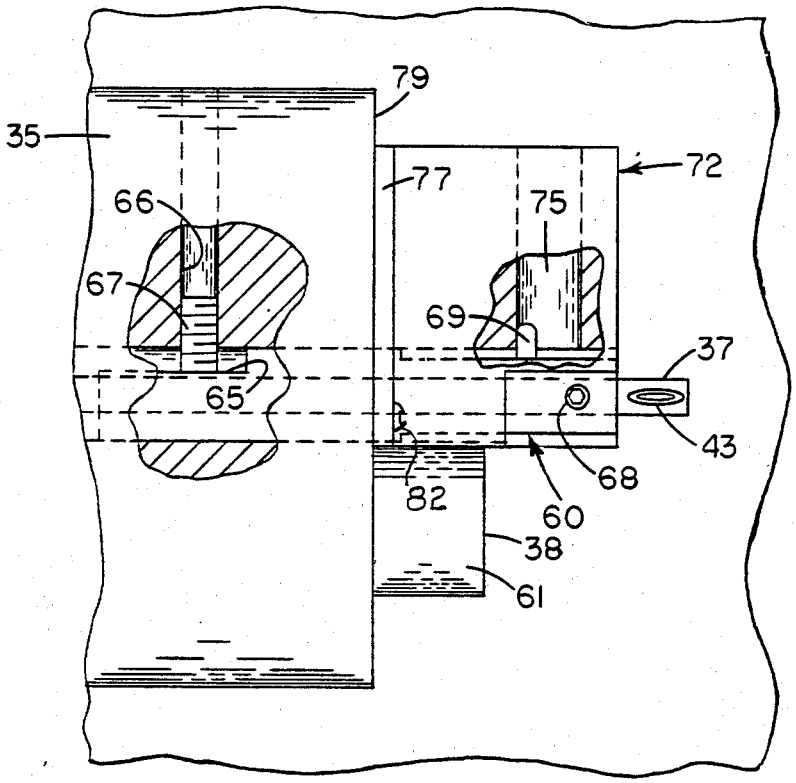
FIG. 5 is a fragmentary elevational view of the front end of the blade holder of FIG. 4.
Figure 7:
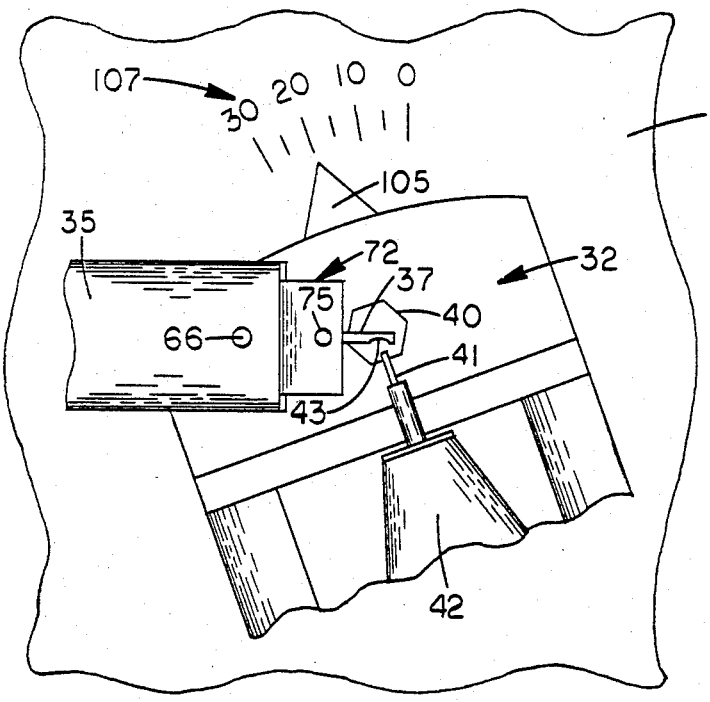
FIG. 7 is a fragmentary plan view of the jig set-up of FIG. 1, with blade introduced into its blade holder position for operation of the invention thereon.

A burr 41 is conventionally attached to a motor 42 in assembly 33, for grinding away a compound (three-dimension) oval port 43, FIGS. 5, 7, included in blade member 37 and by which a desired positive cutting angle therein is obtained. Motor 42 is securely clamped to carriage 34 by means of a clamping block 44, FIGS. 1, 3, suitably secured thereto by counter-sunk screws or bolts (not shown) threaded through the bottom of carriage member 34 into the clamping block itself. An abutment block 45 is suitably secured at a point along the length of carriage 34 for engaging a stop pin 46 mounted in base member 32, to prevent burr 41 from over-reaching within blade 37's compound oval port or opening 43 during cutting operation upon its body formation for opening 43. Such over-reaching by burr 41 could damage the thin wall of tubular member 37, thus destroying for practical purposes use of blade 37 in surgical, or other utilitarian, environments.

In the disclosed embodiment, the rear portion of bore 36, FIG. 2, is of a dimension greater than the diameter of the outer wall of tubular member 37. To firmly support member 37 in subsequent cutting operation on its compound oval port 43, a support assembly 48 is provided and is mounted in tandem to the rear of fixture 35. Support assembly 48 comprises a block 50 spaced in its position from a reduced rear portion 51 of fixture 35, and a spaced pair of rods 52 the ends of which being slip fit in corresponding holes provided in both block 50 and portion 51, FIGS. 1, 2. Block 50 includes a bore 53 of the diameter of blade member 37 and which is in axial alignment with bore 36 of fixture 35. Blade member 37 projects out of bore 36 to thereafter extend through and be supported by bore 53 in block 50, thus, establishing its required support.

It should be understood that blade member 37 may be firmly supported in its fixture 35 by other suitable means. The invention is not limited to the support assembly 48 for supporting the rear portion of the length of blade member 37.

Fixture 35 itself is securely mounted in a suitable manner to a conforming cradle or neck member 55 FIG. 1, which itself is part of a mounting bracket 56 adjustably mounted to table plate 31. Mounting bracket 56 is lengthwise adjustable in position on table plate 31 by means of clamping bolts 57 mounted through slots 58 in bracket 56 and being threaded to table plate 31. The axis of bore 36 is parallel to the axis of the conforming cradle on member 56, which in turn are coincident and parallel, respectively, to the axis of fixture 35.

Figure 6:
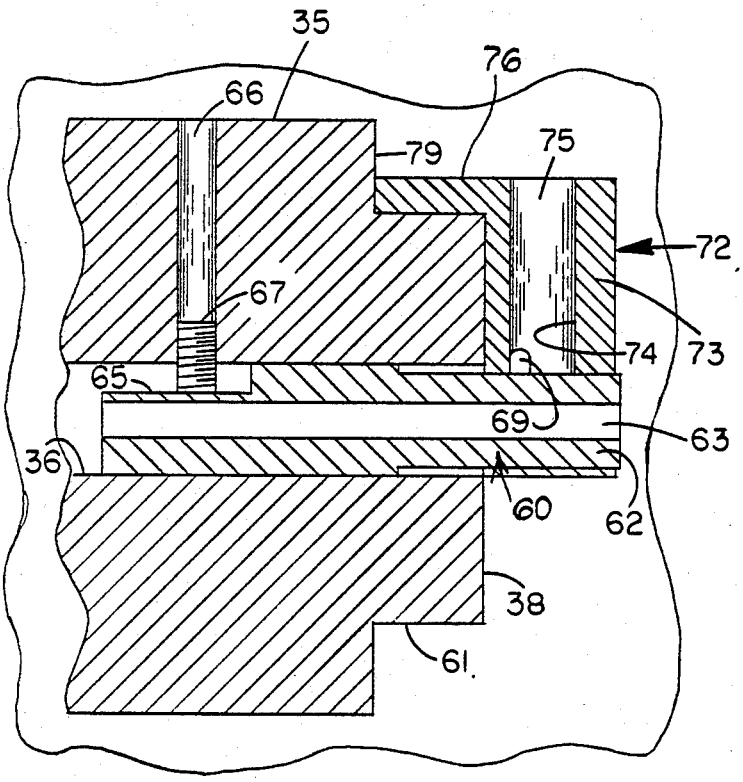
FIG. 6 is a cross-sectional view of FIG. 5, but with blade removed.

A hollow spindle 60, FIGS. 5, 6, is freely mounted in bore 36 at the frontal face 38 of fixture 35. In this embodiment, face 38 is included in a reduced circular boss 61 integrally formed of fixture 35, although such reduced dimension is not essential to the invention, as such a reduced boss need not be utilized. Spindle 60 comprises a cylindrical member 62 having a longitudinal bore 63 in co-axial alignment with bore 36 of fixture 35. Member 62 slip-fits to bore 36 and a flat 65 is machined along a portion of its length, here, adjacent its one end. Upon assembly of spindle to bore, flat 65 correlates by its location to a radially-disposed bore 66 extending through fixture 35 to bore 36. An Allen screw 67 threaded to bore 66, engages flat 65 to secure spindle 60 in position in bore 36. A radially-directed set screw 68, FIG. 5, is mounted in spindle 60, to secure blade 37 thereto, for purposes described hereinafter. Spindle 60 projects outwardly of fixture face 38, and in such projection, a follower 69, in the form of a pin, press-or-slip fit to member 62, extends in an angular direction from member 62. In this embodiment, follower 69 extends radially of the axis of spindle 60. Further, the plane of flat 65 is made at a right angle to pin 69.

A cam or guide assembly 72, FIGS. 8, 9, 4, 5, and 6, is provided for follower 69 and is part of or otherwise securely mounted to fixture 35 in carrying out the invention. Guide assembly 72 comprises a body formation 73 forming a geometrical configuration or camming surface 74 which is to be positioned relative to follower 69 which rides or otherwise engages it. Here, the configuration 74 forms a circular bore 75 having its axis perpendicular to the axes of bore 36 and spindle 60. Bore 75 extends vertically downwardly from a top wall 76 in body formation 73 to cloak follower 69. The present embodiment provides a visible observation through the length of bore 75 for use in assembly of follower 69 to configuration 74, i.e., so that follower 69 is seen to be encompassed by bore 75.

Figure 8:
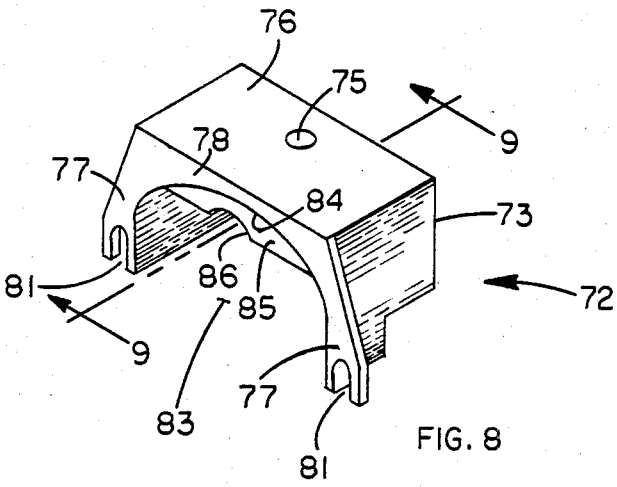
FIG. 8 is a perspective view of a guide or cam assembly used in carrying out the invention.

Cam assembly 72, in this embodiment, includes means for securing it to fixture 35. Spaced flanges 77, FIG. 8, are integrally formed on member 73, each laterally extending from and being flush with a vertical wall 78 which mounts upon a secondary frontal face 79, FIGS. 5, 6, for fixture 35 formed as a result of frontal face 38 being reduced in size by machining boss 61 on fixture 35. A slotted recess 81 is provided at the bottom of each flange 77 for mounting behind the heads of corresponding threaded screws 82 projecting from the secondary face 79, and by which screws 82 securement of assembly 72 to fixture 35 is provided.

Figure 9:
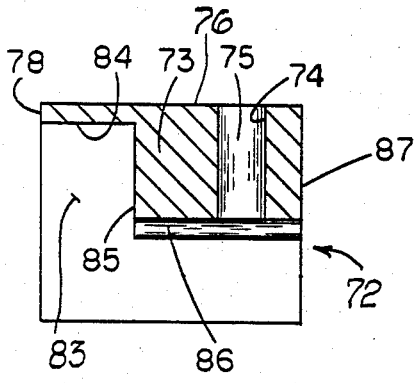
FIG. 9 is a view taken on line 9—9 of FIG. 8.

For this embodiment which includes reduced boss 61 in fixture 35, guide assembly 72 includes a recess 83, FIGS. 8, 9, projecting inwardly from wall 78. Recess 83 is formed by a wall 84, FIGS. 8, 9, which conforms to the configuration of boss 61, for direct mounting thereon, and a bottom or base face 85 which mounts directly upon frontal face 38, FIG. 6, in assembly of member 73 to fixture 35. An arcuate wall 86 begins at and extends in a direction perpendicular to and away from base face 85, towards passageway 75, for direct and complementary mounting upon the portion of hollow spindle 60 projecting out of frontal face 38. In its direction towards passageway 75, arcuate wall 86 intersects same, and continues, to terminate at outer wall 87 opposing wall 78. Thus, it will be seen that arcuate wall 86 wraps around, so to speak, spindle 60, in the assembly of member 73 to fixture 35, with follower 69 disposed within passageway 75.

Figure 11:
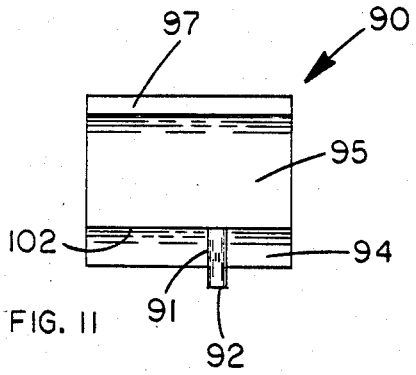
FIG. 11 is an end view of the element of FIG. 10.
Figure 10:
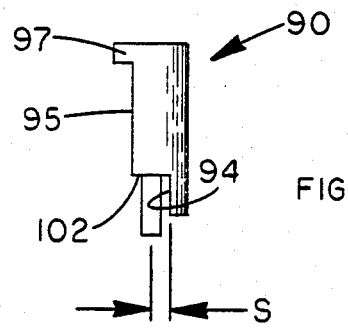
FIG. 10 is a side elevational view of an element which assembles to the guide assembly of FIGS. 8, 9, to carry out the invention.
Figure 19:
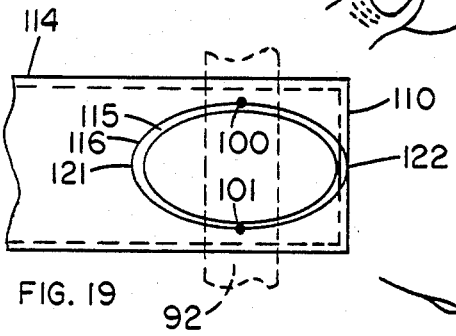
FIG. 19 is a view taken on line 19—19 of FIG. 18.
Figure 17:
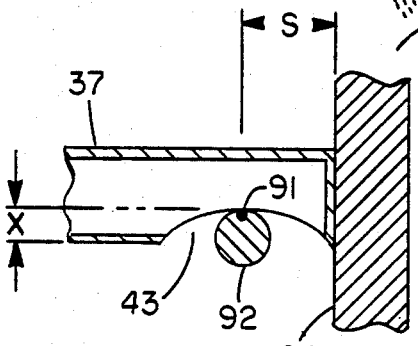
FIG. 17 is a view taken on line 17—17 of FIG. 16.
Figure 18:
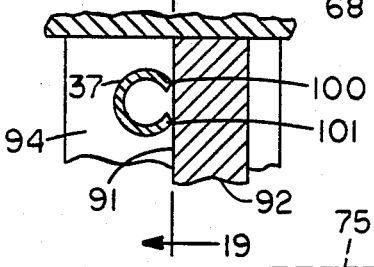
FIG. 18 is a view taken on line 18—18 of FIG. 16.

A means 90, FIGS. 10 and 11, is provided to displace or set the unfinished compound oval opening 43 to a position at which accurate grinding, as by burr 41, to form a positive cutting angle in its body formation follows, and to seat such unfinished opening 43 in an initial position after which it is moved to the extent of movement for cam follower 69 during the grinding operation. Means 90 comprises a plane or line 91, FIG. 11, in the surface of a pin 92 disposed perpendicular to table plate 31 or at a right angle to the axis of blade 37 when the latter is supported in hollow spindle 60. Line 91 in pin 92 is also parallel to the pin's axis. Pin 92 is securely mounted as part of and in a body assembly for means 90, such means including a wall 94 against which the end of blade 37 is positioned or abuts in its projection out of fixture 35, and a body surface 95 for engagement with outer wall 87, FIG. 9, of guide assembly 72. The body assembly includes a ledge 97, preferably perpendicular to surface 95 to assist the sliding engagement of surface 95 upon outer wall 87 of member 73, but more importantly, to facillitate engagement of pin 92 with the blade's body formation for its endless edge forming opening 43. Such facillitation is obtained by ledge 97 sliding on the top wall 76 of member 73. Wall 94 is recessed a distance from wall 95 and is perpendicular to the axis of blade 37. A distance s extends between stop-wall 94 and the axis of pin 92. Such axis and line 91 lie in a plane which is parallel to the plane of wall 94. The distance s, then, provides a manner by which line 91, i.e., pin 92, registers compound oval opening 43. Spacing s is so chosen that line 91 reaches the greatest depth x, FIG. 17, for opening 43 formed at a desired displacement along the length of and from the end of blade member 37. Such depth x lies halfway the length of opening 43. As seen in FIG. 17, pin 92 is positioned at the greatest depth x of opening 43, with its line 91 lying in the plane ending the distance s from wall 94. FIGS. 18, 19 show two points 100, 101 of contact made by line 91, thus, pin 92, on the blade's body formation which forms, oval opening 43. This meeting or seating of pin 92 with contact points 100, 101 constitutes registration of pin 92 to compound oval opening 43. In this embodiment, pin 92 depends from a ceiling 102, FIG. 10, forming the recess confronting wall 94.

The outward extent of the projection of opening 43 is set by wall 94 and the distance s. In this embodiment, one end of the opening 43 is superimposed upon the blade member's end (which abuts wall 94); see FIG. 19. Consequently, knowing a desired length for opening 43, wall 94 also functions as a reference plane from which the position for pin 92 in its registering function readily can be determined. However, a more basic reference plane, line or point by which determination of such setting and registering for opening 43 can be made is the (vertical) plane of the pivot point (at bolt 40, FIG. 7) for base plate 32. Irrespective of whether one end of opening 43 is superimposed on the end of blade member 37 or the length of opening 43 being elsewhere along a tubular member 37, the linear distance from the plane of such pivot point to the center of opening 43 and to the end of member 37 provides the data required to establish the positions of wall 94 and pin 92 relative to such pivot-point plane. A body assembly 90 and a cam assembly 72 can be made with suitable dimensions thereon to establish the positions for wall 94 and pin 92 from such plane. Were a cam assembly 72 integrated into a fixture 35, the distance between the face of fixture 35 and the plane for the pivot point would be helpful in establishing a wall 94 and a pin 92, ie., their positions.

Once the projection for opening 43 is set and it has been properly registered, and blade 37 secured to spindle 60, means 90 is cast aside, and cutting action at port 43 is undertaken by means of burr 41 mounted on its motor 42 on reciprocable carriage 34 in base member 32. Member 32 is stationarily held in position by means of, say, a small C-clamp 103 (shown in phantom, FIG. 1) or the like securing it to table plate 31 at its one end, and a point mount such as the bolt 40, FIG. 7, threaded through at its other end to plate 31. Such a stationary arrangement, it will be seen, FIG. 7, is angularly adjustable, by using a pointer 105 longitudinally aligned with burr 41 at its one end and being correlated to a scale 107 of degrees inscribed in plate 31. The 0° mark on scale 107 is drawn on a geometrical line perpendicular to the axis of spindle 60 and blade member 37 Thus, the angle of attack for burr 41 upon the edge forming port 43 can be controlled while achieving the objective of a positive cutting angle on such edge, described more fully hereinafter.

OPERATION

Flat 65 of spindle 60 is inserted at face 38 into bore 36 of fixture 35, after which cam assembly 72 is attached to fixture 35 by means of screws 82 being tightened in the slotted recesses 81 of its flanges 77, keeping in mind that in this particular step, follower 69 is caused to be introduced into bore 75 as spindle and cam assembly are mountd to fixture 35. This is readily accomplished by visual observation by the operator, viewing down bore 75 to either observe or not observe pin 69 in bore 75. Spindle 60 is manually rotated about and longitudinally displaced in bore 36 until pin 69 can be observed in bore 75. Thereafter, screws 82 are tightened to securely mount the cam/guide assembly 72 to fixture 35.

Follower 69 is caused to engage the cam surface or wall forming bore 75 of guide assembly 72, preferably at a point closest to end face 38 of fixture 35, and as shown in FIG. 6. This is simply done by pushing spindle 60 to the left, in FIG. 6, by the operator. Allen screw 67 in bore 66 is tightened upon flat 65, with a suitably-sized known wrench tool. Blade member 37 is inserted into bore 63 of spindle 60, maintaining projection of oval opening 43 outwardly, i.e., to the right of the fixture's face 38 and of wall 87 of cam assembly 72. The rear end of member 37 is caused to project from boss 51, FIG. 2, to be thrust through bore 53 of supporting aligning block 50. Block 50 is previously assembled to boss 51 by means of the pair of rods 52 joining them together.

With blade member 37 mounted in bore 63 of spindle 60 and supported in alignment by block 50 adjacent the rear of fixture 35, and cam assembly 72 attached to fixture 35 with opening 43 to the right of wall 87, the body of means 90 is now brought to bear against cam assembly 72 and the end wall 110, FIG. 19 of blade 37. FIGS. 12–16, incl., graphically portray steps to properly seat compound oval opening 43 in its exact position relative to spindle 60 so that blade 37 can be secured to spindle 60 prior to grinding action on the edge forming opening 43.

Figure 12:
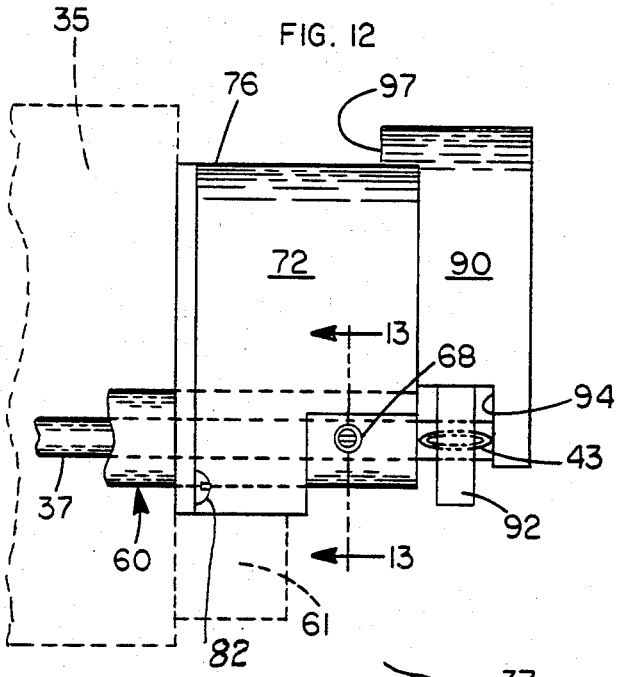
FIG. 12 is a fragmentary elevational view of fixture, guide assembly, the element of FIG. 10, and blade member in assembled relationship to properly position the blade member for subsequent cutting action on its port.
Figure 14:
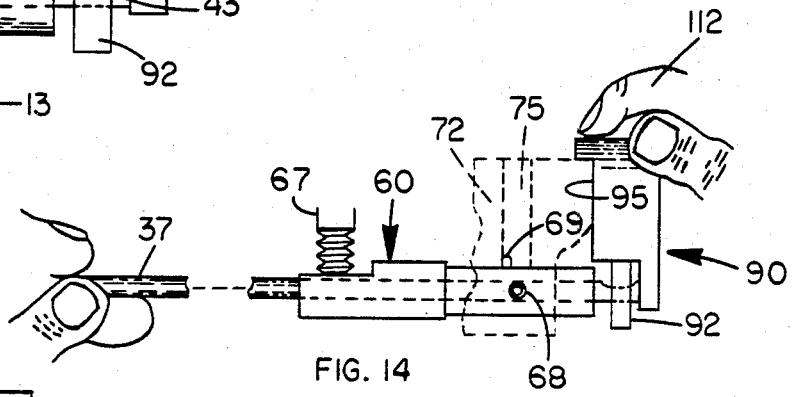
FIG. 14, 15 and 16 are schematic views disclosing the manner by which registration of the port in the blade member is achieved.
Figure 15:
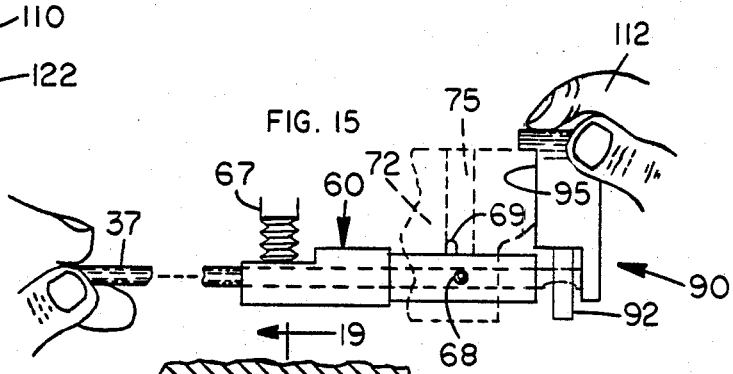
Figure 16:
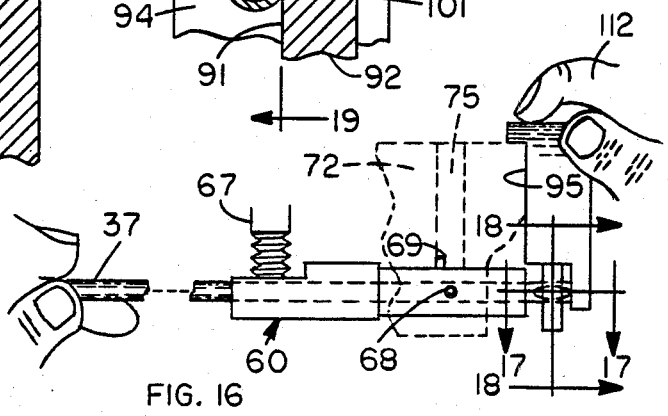

In particular, wall 95 of means 90, FIGS. 14–16, is made flush with wall 87 of body member 73, while ledge 97 is set upon top wall 76. While such wall and ledge engagements exist, end wall 110 of blade member 37 is caused, by manual pushing at its rear end, to engage wall 94. FIGS. 12, 14 16 show pin 92 in full view with oval opening 43 of blade 37 behind it. As end wall 110 of blade member 37 engages wall 94 of means 90, blade 37 is rotated or oscillated to-and-fro by the same hand of the operator, between its positions shown in FIGS. 14, 15 and 16. While this to-and-fro rotation is occurring, the operator's other hand 112 is causing pin 92 to assert itself against the body formation forming unfinished compound oval opening 43, remembering that distance s has already been calculated and utilized in reference to a particular displacement or location along the length of blade member 37 for opening 43. The operator thus ascertains accurately a pre-grinding position for oval opening 43. Such position is shown specifically in FIGS. 17, 18 and 19 wherein it is observed that the deepest point in blade member 37 for opening 43 is shown to be at a half-way point in the length of opening 43 and coincident with line 91 of pin 92. FIG. 17 also represents the relationship between blade member 37 and pin 92 in the registration of compound oval opening port 43.

Figure 13:
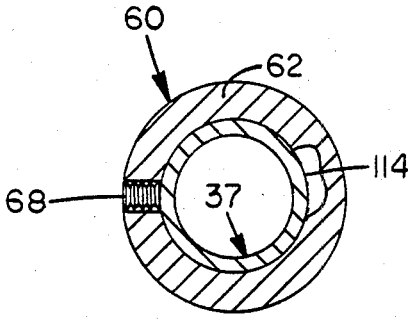
FIG. 13 is a view taken on line 13—13 of FIG. 12, but with the cam assembly of FIG. 8 removed.

Pin 92 by reason of its proper assertion simultaneously upon opposing points 100, 101 of blade 37, holds such blade until set screw 68, FIGS. 12–16, radially threaded through the wall of spindle 60, is tightened against outer wall surface 114, FIG. 13, of blade 37. This step of tightening, it is important to note, requires that prior to tightening set screw 68, follower pin 69 of spindle 60 strikes against a particular point on the wall forming bore 75 in cam assembly 72. This point of striking was accomplished with Allen set screw 67, supra, and is shown in FIGS, 14, 15, 16 which show follower pin 69 to be at its extreme left position in such FIGURES, i.e., spindle 60 is in its innermost position relative to fixture 35.

With set screw 68 secured against blade member 37, Allen screw 67, in bore 66 of fixture 35, FIG. 6, is now loosened or unsecured from flat 65 of spindle 60. The resulting arrangement is that spindle 60 and blade 37 move together as a unit which is capable of linear and rotational displacement to the extent of movement for follower pin 69 along the geometrical configuration or cam surface forming bore 75 in cam assembly 72.

Assume now that means 90 (or other manner of setting the projection of opening 43) is cast aside and that base member 32 is clamped to table plate 31 by means of C-clamp 103, at, say 20°, FIG. 7, per pointer 105. Burr 41 is advanced on its carriage 34 until abutment block 45, FIG. 1, strikes stop pin in 46, whereby the end of burr 41 does not overreach within oval opening 43 to the extent of striking and damaging wall 114 of blade 37. Further, that blade and spindle are fixed to each other and can move linearly and rotationally in fixture 35 to the extent of movement of follower pin 69 in bore 75 of cam assembly 72.

Action Forming A Positive Cutting Angle On The Blade's Oval Cutting Edge

A description of the action of burr 41 relative to the body formation from which a finished port 43 is formed follows. The result of this grinding action produces a positive cutting angle across the thickness of the blade's wall 114.

Figure 32:
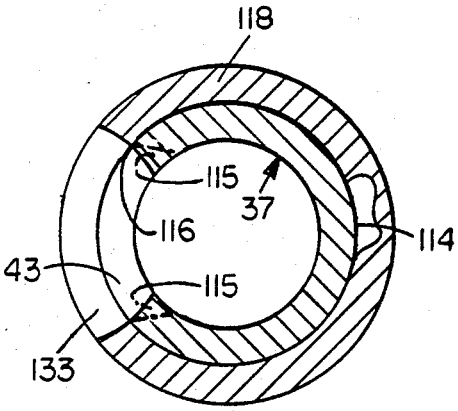
FIG. 32 [sheet 4] is a cross-sectional view of a cutting edge of a blade member and its sheath prior to a grinding action by the burr.
Figure 33:
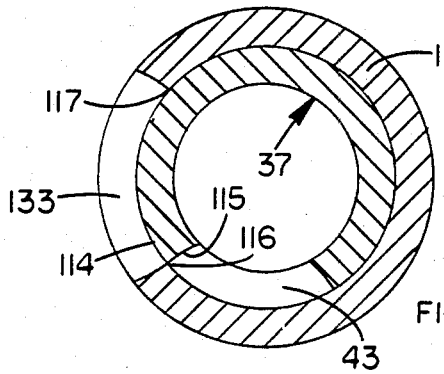
FIG. 33 [sheet 4] is a cross-sectional view similar to FIG. 32 but with the cutting edge of the blade member in contact with the cutting edge of the sheath.

Reference to FIG. 20–34, incl., illustrates development of a positive cutting angle across the thickness of the blade's wall 114 forming a finished compound oval opening 43. Preliminarily speaking, an inspection of FIGS. 32, 33 exemplifies in analysis both the initial formation of a compound oval opening 43 in wall 114 and the manner of cut in such initial formation. A surface 115, with its attendant thickness, including the two blackened area portions in FIG. 32, is initially generated. The blackened portions in FIG. 32 represent a thickness and surface configuration which extends completely around initially-formed opening 43 in blade member 37. The surface 115 and its cutting edge 116, FIGS. 32, 19, when rotating relative to a cutting edge 117 on a sheath member 118, FIG. 33, does not result in a clean, sharp scissors-like action against tissue or other substances being removed. The result usually is a ripping or tearing action.

Figure 34:
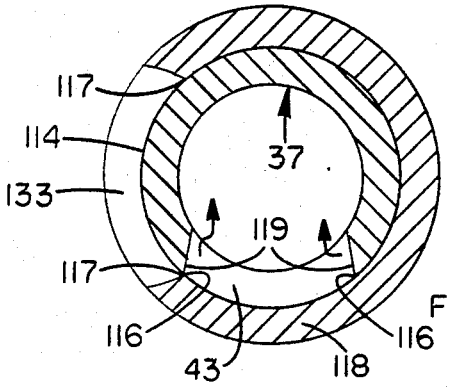
FIG. 34 [sheet 4] is a cross-sectional view similar to FIGS. 33, 34, but showing finished cutting edges for blade member and sheath and in relation to each other during a cutting action on, say human.

On the other hand, were the total thickness or volume of metal around opening 43, which is represented by surface 115 and the two blackened area portions in FIG. 32, eliminated, i.e., around the entire or endless length of cutting edge 116 (FIG. 19), what is deemed a positive cutting angle, FIG. 34, along such entire or endless length for port 43, results. Such result provides an effacacious, scissors-like like action, i.e., slicing off of material, tissue or the like in a clean, sharp manner. A void or space is generated in front of a different surface 119, FIG. 34, for port 43, and from which, as shown by arrows in FIG. 34, such cut-off tissues or substances would be quickly removed by means of vacuum or suction developed in the apparatus to which blade 37 and sheath 118 are operatively connected, i.e., down the hollowness of blade member 37, to be expelled elsewhere from the apparatus in known manner, and which is not a part of this invention.

Returning now to FIGS. 20–31, incl., we can perceive how such a positive cutting angle, including surface 119, FIG. 34, is generated across wall 114 to form a finished compound oval port 43. Initially, it is to be remembered that rotary and linear motion for the unit comprising spindle 60 and blade member 37 is provided by release of Allen screw 67 in bore 66 of fixture 35, FIG. 6 [and sheath 118, of course, is not mounted on member 37 ].

Preferably, the unit with opening 43 is first linearly displaced slightly to the right so that burr 41, at a 20° angle, FIG. 7, is inserted or introduced to the left of vertex 122, FIG. 19, into opening 43, FIG. 19, by advancing carriage 34, FIG. 1, so that burr 41 sets in alignment with the thickness 115 of wall 114. In this manner, burr 41 does not damage end wall 110 of blade 37 and which could affect action of the vacuum, supra. Thickness 115 is ground throughout the formation of opening 43 except for an immediate vicinity to vertex 122 which actually is superimposed upon end wall 110, FIG. 19.

Figure 20:
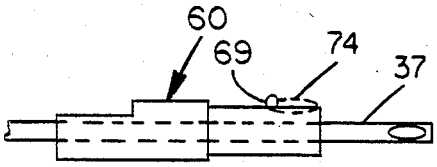
FIGS. 20–22, 23–25, 26–28, and 29–31 are sets of schematic diagrams each set respectively showing elevational, plan and end views for different positions of the unified blade member and its supporting spindle, and for the follower pin on the spindle in relation to its cooperating guide assembly bore, as grinding action by a horizontally disposed burr (not shown) on the oval edges forming the port in the blade member takes place.
Figure 23:
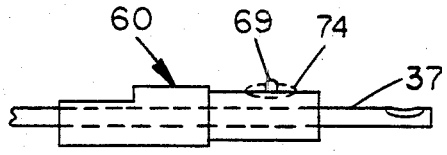

Burr 41 enters in its singular (horizontal) plane into opening 43, while advance and retraction of it is controlled, as by hand, although other actuating means may be used. The compound motion of blade member 37 is controlled in relation to rotating burr 41 during the latter's relatively stationary position. It is to be noted that the singular (horizontal) plane of the axis of burr 41, the (horizontal) plane in which the major (geometrical, plane and solid) axis of opening 43, and the axis of blade 37 are co-planar, prior to loosening Allen screw 67, FIG. 6. Follower pin 69 initially then is caused to follow camming wall 74 of bore 75 at a point between where it is shown in FIGS. 20 and 23. The movement of the unit 60 including blade 37 is controlled at the rear of blade 37, FIG. 1, adjacent block 50. Other means than the operator's hand on the rear of blade 37 may be utilized to move the unit as grinding action takes place on thickness 115.

Figure 21:
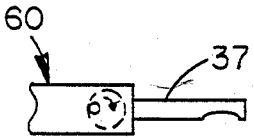
Figure 22:
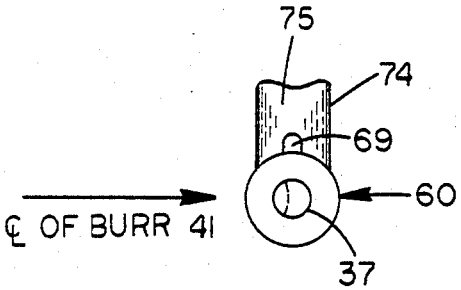

As shown in FIGS. 21, 22, as follower 69 slowly moves in the direction of the arrow, FIG. 21, along and in cammed engagement with wall 74 of bore 75, blade 37 rotates clockwise and linearly displaces to the right. Burr 41 grinds upon thickness 115 and therealong as follower 69 moves in the direction of the arrow.

In addition to the hand pressure of follower 69 on wall 74, the camming being sensed sufficiently by the human operator, he may mount above jig set-up 30, in a convenient manner, a magnifying glass (not shown) through which the direction of movement of surface 115 in an enlarged environment can be observed, while thickness 119 is being generated by the grinding action of burr 41 to produce the noted void or space thereby, FIG. 34.

Figure 24:
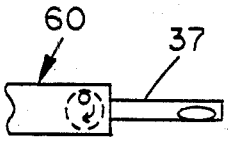
Figure 25:
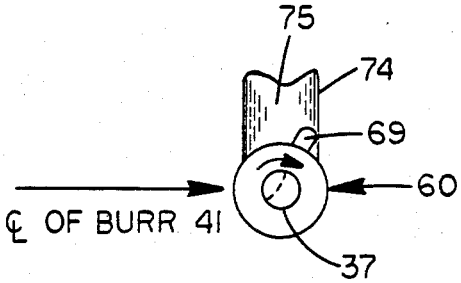

FIGS. 23, 24 show follower 69 at a one-quarter way of camming path 74, from that of FIGS. 20–22. FIGS. 23–25 show the point of rotation for blade 37 as burr 41 continues to work on surface 115.

Figure 26:
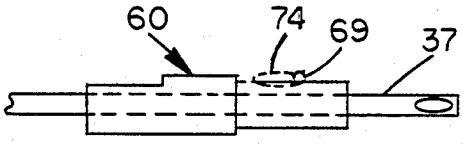
Figure 27:
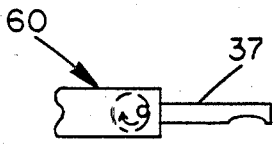
Figure 28:
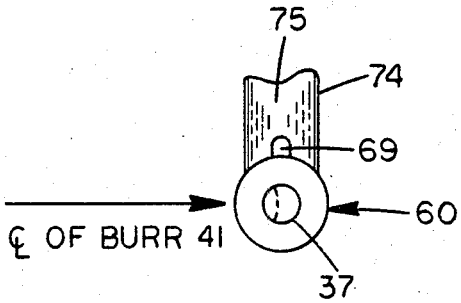

FIGS. 26, 27 show cam follower 69 at a one-half way about camming path 74, from that of FIGS. 20–22. FIGS. 26– 28 show the point of rotation for blade 37, with burr 41 at vertex 121, FIG. 19, of opening 43. Here, cam follower 69 seats on the forward most or extreme right point of camming surface 74.

Figure 29:
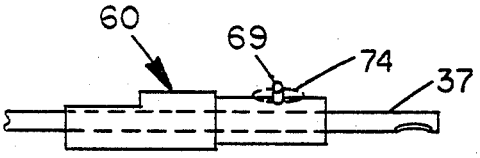
Figure 30:
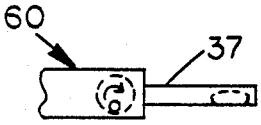
Figure 31:
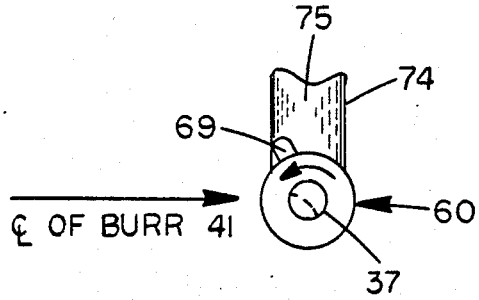

FIGS. 29, 30 show cam follower 69 at a three-quarters way along camming path 74, from that of FIGS. 20–22, while FIGS. 29–31 show the point of rotation for blade 37, with burr 41 midway the length of opening 43, however, grinding at a point along the edge opposing the point on the edge which was ground and as shown in FIGS. 23–25.

Finally, the unit 60 including blade 37 is caused again to assume its position shown in FIG. 20 at which vertex 122, FIG. 19, of opening 43 has approached burr 41. In view of the 20° angle, supra, burr 41 is retracted to prevent damage to end wall 110 of blade 37.

The positive cutting angle generated by the position of thickness or surface 119 is produced throughout the endless length of opening 43, by changing, when and if necessary, the angle of attack taken by burr 41, seen as 20° in FIG. 7. However, it may be noted from FIG. 35 that the effective length e of actual cutting of tissue and the like and produced by a surgical blade 37 rotating within its sheath 118 does not extend to the vertices 121, 122, FIG. 19, of opening 43, i.e., completely around the ovalness of the opening. It has been found that actual cutting or severing of tissues, etc., does not occur near vertices 121, 122 or their immediate contiguous vicinities. Rather, that the effective severing lengths or stages occur between the distance e, FIG. 35, which is substantially along the longitudinally-disposed portions of the cutting edges 116, 117 of such tubular members. As finished blade 37 continues its rotation relative to its sheath 118, the appearance of opening 43 decreases in size as shown by the phantom lines, FIG. 35, until such appearances no longer exist, which is, of course, at the moment of separation of all tissue and substances being cut off from their bodies which remain exteriorly of the surgical instrument. Thus, the angle of 20° for burr 41 can remain constant for grinding edge 119 on blade 37 and still obtain an efficacious positive cutting angle. As indicated, such an angle prevents damaging end wall 110 of blade 37 where opening 43 is contiguous to or meets such end wall. However, the invention contemplates a 0° angle as well and any angle to either side of the 0° angle or perpendicular plane to the axis of blade 37.

In FIG. 34, thicknesses 119 at points on opposing lengths of opening 43 represent, with corresponding points on edges 116 on such opposing lengths, a positive cutting angle for blade 37. The positive cutting angle is shown by the fact that edge 116 on blade 37, as the latter rotates, cuts or sweeps across edge 117 forming opening 133 in sheath 118 so as to be able to cut swiftly and quickly into and through tissue and other substances drawn into openings 133, 43. Were a thickness 115, FIG. 33, to cut or sweep across edge 117, it would be but a sliding action, one edge (116) sliding across the other (117), with no clean separation of drawn-in substances.

It should be noted that the cutting plane of the rotating burr 41, preferably a 1 mm diameter diamond-plated mandrel, is offset, in parallel manner, to its axis which lies in the horizontal plane passing through the axis of blade member 37. Thus, grinding upon any point of thickness 115 as it is fed into burr 41 occurs in a plane above or below the horizontal plane containing the axes of the burr and the blade, to the extent of one-half the diameter of burr 41.

Various parameters may be taken into consideration for controlling the width and length of an opening 43 and the amount of blackened area portions, FIG. 32, which can be ground away by burr 41.

The length of pin 69 determines the width of opening 43. The longer the pin, the less rotational movement in a camming cycle for cylindrical unit 60 which includes blade 37. Thus, the opening's width is less, i.e., the ovalness of it tends to be flatter (towards a planar condition). The shorter the pin, the greater is the rotational movement for cylindrical unit 60 in its camming cycle about bore 75. Thus, the opening's width is wider (more of a three-dimensional condition). An inspection of FIG. 25, showing a short pin, makes apparent the degree of rotation available for blade 37 with such a shortness of pin, viv-a-vis a pin having a longer length substituted in FIG. 25 for the short pin shown therein.

The pin's length also determines just how much of a cut of the blackened area portions, FIG. 32, of each thickness 115 is taken away from its surface, to generate the surface forming thickness 119. By increasing the pin's length, and with its end engaging camming surface 74 as cylindrical unit 60 cycles, the lesser rotation there is for blade 37, and consequently, the lesser amount of blackened area portion, FIG. 32, is ground away from the surface of thickness 115. By decreasing the length of pin 69 for a camming cycle of unit 60, there is a greater rotation for blade 37. Consequently, a greater amount of blackened area portion, FIG. 32, is ground away from the surface of thickness 115. In other words, the shorter the pin 69 is, the greater the void in front of the plane of the generated thickness 119, FIG. 34.

The length of opening 43 can be controlled in two ways. By the sizes and the diameters of pin 69 and of bore 75. By increasing the diameter of pin 69, its axis or center is moved farther away from wall 74 at either of the vertices 121, 122; note here that the full shank of pin 69 engages wall 74 at these two points. Consequently, burr 41 can not grind as far in a lengthwise direction at these two points. By decreasing the diameter of pin 69, its axis or center moves closer to wall 74 at these two vertices 121, 122. Thus, burr 41 is able to grind farther lengthwise along the length of opening 43.

Upon decreasing the diameter of bore 74, the length of opening 43 is decreased. Increasing the diameter of bore 74 increases the length of opening 43.

It also may be noted that pin 69 may be off 90° to the point of actual cut of thickness 115, as the camming cycle can be viewed as a milling or grinding machine operation, and to which principles for milling and grinding are able to be applied.

Preferably, the end of pin 69 is spherical or bullet-shaped so that a better control on the shape of opening 43 is maintained, as cylindrical unit 60 cycles. However, should it be desired to change the configuration of opening 43 by changing the pin's end to a non-truncated end, it may be done.

Forming Initial Compound Oval Openings in Blade and Sheath

Referring now to FIG. 36, jig set-up 130, similar to that shown in FIG. 1, is used to initially form oval openings 43, 133, FIGS. 32–34, 38, in their corresponding members 37, 118. A full tubular member 37 is first introduced into a full outer tubular member 118. By "full" is meant that no openings are in the walls of such members. They are clamped together (not illustrated) in expedient, known manner, as at 134, FIG. 36, to prevent relative rotation as openings 43, 133 are simultaneously formed. End wall 110 of member 37, FIG. 37, is seated against interior base 136 of end wall 138 of member 118 prior to such clamping. The members, clamped before or after the following insertion, are inserted into a bore 139 of a tube holder or fixture 140 securely mounted on a table 141 for jig 130.

The clamped combination of members 37, 118 is secured in fixture 140 by means such as an Allen screw (not shown) in a radially extending bore (not shown) disposed along the length of fixture 140 in suitable and known manner.

A diamond impregnated grinding wheel 145 having a radiused end for making the initial openings 43, 133 is secured at the end of a shaft of a motor 146. The rotating axis of wheel 145, which is coincident with the axis of the rotating shaft of motor 146, lies in the same plane as the horizontal plane for the axis of bore 139 and axes of members 37, 118. Motor 146 is securely mounted on a carriage 148, such as by a clamp 149, the carriage being reciprocable along a flat base plate 150 pivotally mounted as at 151, FIG. 36, such as by a bolt, to jig table 141. Base plate 150 rotates about pivot point 151. Base plate 150 also is linearly displaceable in a direction perpendicular to the axis of bore 139 of fixture 140, thus, also perpendicular to the axes of members 37, 118, irrespective of a pivoted position for base plate 150 at a given moment. This is accomplished by means of a disc 152 having a depending circular lug 153 slip-fitting into a slot 155 in base plate 150. Slot 155 is of greater length than the diameter of lug 153 in order for relative linear movement between base plate 150 and table plate 141. The center of disc 152 is mounted at pivot 151, while the longitudinal center line of slot 155 passes through pivot point 151 and is perpendicular to the axis for cutter 145 or its shaft. A housing 158 secured to base plate 150 provides for an adjusting screw 159 in alignment with pivot point 151. Screw 159 has its end engaging the periphery of disc 152. Thus, adjustment of screw 159 moves or shifts base plate 150 in relation to jig table 141 to which fixture 140 is fixed. As diamond wheel 145 is relatively stationary to base plate 150, it likewise moves in the same linear fashion when the length of screw 159 is adjusted in relation to its engagement with the periphery of disc 152.

The exterior surface of end wall 138, FIG. 38, projects a distance p, FIG. 36, to the right of a (vertical) plane passing through pivot point 151. Distance p is parallel to the axis of fixture 140 and equals one-half of a length measured from end wall 138 and through which wheel 145 will sweep to form initial openings 43, 133.

A measuring tool (not shown), such as a block having a vertical face against which end wall 138 is caused to abut prior to securing the combination of clamped members 37, 118 to fixture 140, may be used to position the exterior surface of end wall 138 at the end of distance p, by mounting it to face 142 of fixture 140. The effective length of such block is determined by addition to the distance p of the distance between the plane of face 142 and the (vertical) plane passing through pivot point 151.

The action to produce initial openings 43, 133 in their complimenting positions in their respective tubular members 37, 118 is the motions of sweeping grinding wheel 145 about an arc as flat plate 150 pivots about point 151 and moving or shifting the radiused end of wheel 145 towards the axes of members 37, 118 as plate 150 slides in a direction towards the axis of bore 139 and axes of members 37, 118. Such sliding occurs by the turning of screw 159 to free plate 150 for movement towards such axis and axes.

The pivoting and shifting motions produced for grinding wheel 145 provide the result of the initial compound oval openings 43, 133 in their corresponding members 37, 118. To assist in obtaining these motions, a stop block 161 secured to base plate 150 and a block member 162 slidably attached to base plate 150 are provided to lock carriage 148 in its advanced position as such motions occur. When carriage 148 advances, a carriage bar 163 abuts block 161 and member 162 slides in behind the rear of carriage bar 163 to suitably lock carriage 148 in a stationary position on base plate 150. Grinding wheel 145 now is in proper position to sweep and displace, to form initial openings 43, 133.

The diamond impregnated wheel 145 itself includes a full radius in its configuration and its nature provides the wherewithall to bite into the metal of tubular members 37, 118 in forming initial openings 43, 133. In connection with the smallness and thinness of the tubular metals on which it is acting, a typical diamond cutter is 0.110 inch thick, has a 5/16" diameter, and a full radius of 0.055 inch on its end, and works on 304 stainless steel material out of which blade and sheath are being made. However, a stainless steel 440-F material is utilized for a tip member in which an opening 43 is to be disposed, more fully described below.

Operation

The combination of clamped members 37, 118 is secured in fixture 140, as indicated above, and with the exterior surface of end wall 138 of member 118 projecting a distance p past the (vertical) plane of pivot point 151. Carriage 148 is advanced to its locked position on flat plate 150. Grinding wheel 145 is juxtapositioned to the walls of elements 37, 118. Motor 146 is turned on, driving wheel 145. Screw 159 is turned in the direction of its arrow, FIG. 36, as wheel 145 is pivoted about point 151, both of such actions being manually controlled. Base plate 150 slides in a direction towards the axes of members 37, 118 and perpendicular to the axis of bore 139 and the axes of members 37, 118. Wheel 145 sweeps across and begins to break the metal wall of member 118 first. As continuing adjustments of screw 159 are undertaken and sweeps of wheel 145 are made, the walls of both members 37, 118 are broken and oval openings begin to be generated. Eventually, the formations of initial openings 37, 118 are generated. When the sweep of wheel 145 reaches intersection y, FIG. 38, it being the juncture of the exterior tubular surface of wall 123 of member 118 and its end wall 138, the lengths for the initially formed opening 43,113 are established.

After this operation, members 37, 118 are removed from jig 130 and separated. Tubular member 37 then is preocessed in accordance with its description above. Any burrs remaining about opening 133 of member 118 are expediently removed in known manner as in the case for metal edges. After a positive cutting angle is incorporated into opening 43 of member 37, it with opening 133 of its partner sheath 118 are lapped with suitable known compound to provide a set of two complementing members ready for cutting use in surgical operations The set is adapted in known fashion to an apparatus such as disclosed in U.S. Pat. No. 3,618,611, and used particularly in surgery on the meniscus of a knee.

Making Each of The Tubular Members 37, 118

Reference to FIGS. 39, 40 and the following description provides a disclosure of the formation of each of the tubular members 37, 118 prior to any operation of a grinding to produce any opening therein.

FIGS. 39, 40 represent in cross-sectional appearance initial circular or tubular metal elements 171, 172, of the same diameter and out of which each tubular member 37, 118 is made. Each tubular member 37, 118 is initially formed by the uniting of these two elements 171, 172 without any oval opening therein. Tubular element 171 is of a suitable length, while tubular element 172 is cut to a tip-like length approximate to its final length which is finalized after the following steps.

First, the tube member 171 and its tip member 172 are bored out in separate conventional machining operations, to form their respective inner wall dimensions, which are substantially the same. However, an end wall dimension 174 remains on tip member 172 after its boring or blank-out machining operation is completed. Thereafter, the outside diameter of tip member 172 is reduced along a length as at 175, terminating at a shoulder 176, and then cut to its final length. To accomodate in member 171 the smaller dimension 175 of tip member 172, the end of member 171 is bored out, as at inner wall 177, for fitting thereto the reduced outer dimension of wall 175. The end of wall 175 seats upon a shoulder 178 in member 171 formed as a result of boring inner wall or dimension 177, while wall 175 itself slip fits to wall 177. As these members slip fit to one another, the shoulder 176 formed by reduced dimension 175 seats upon or engages annular end 180 of member 171, while annular end 181 of element 172 seats on shoulder 178 of member 171. The resulting fit of members 171, 172 is illustrated by a line of juncture 184, FIGS. 35, 38 appearing as the juncture of end 180 and shoulder 176.

Prior to securely fitting tip member 172 to member 171, member 172 is heat treated to a Rockwell hardness of 55 to 58, as cutting action for surgical operations requires such hardness. Tip member 172 is silver brazed to member 171 in known fashion. For surgical use, stainless steel 440-F bar stock is utilized for element 172. The shank of each of the tubular members 37, 118, i.e., member 171 here, is purchaseable as a tube. The tip member 172 is purchaseable as bar stock, and then bored out to its flat bottom or wall 174.

It may be noted that the distance between juncture line 184 and end wall 138, i.e., to the intersection y, may be chosen, as shown here, to be substantially equal to the length of opening 43, 133 which are formed initially by grinding wheel 145 and as described above.

It should be apparent that the step of heat treating is necessary in this embodiment of the invention for tip member 172 only, and not the entire length of a blade 37 of which tip member 172 is but a portion, as opening 43 is formed about endless edge 116 which is disposed in tip member 172. It is this edge which requires a certain degree of hardness for cutting of tissue and other substances involved in surgical operation on the body.

Nor is the invention limited to the steps of forming, joining and securing members 171, 172 together. The invention is adaptable to a blade and sheath formed of tubular members which are not the result of an assembly of tip and tube members.

For an actual jig set-up in which a member 118 has a 0.166 inch O.D. and a 0.134 I.D., member 37 has a 0.134 inch O.D. and a 0.111 inch I.D. The perpendicular distance between a vertical line passing through pivot point 151 and the axis of bore 139 and axes of member 37, 118 is 0.300 inch. When the distance p is 0.135 inch to end wall 138 of member 118, a length of 0.270 inch is established. Wheel 145 includes a 5/16" diameter and a 0.055 inch radiused end.

It should be noted that wheel 145, in making its last sweep to establish the desired lengths in the initially formed openings 133, 43, is not necessarily pivoting at the 0.300 inch distance mentioned above, but rather is closer to the axes of members 37, 118. For example, the pivot point for wheel 145 in the above noted actual set-up is 0.094 inch from the 0.300 inch reference point for pivot 151, and the arc that is generated is subtended by a 0.250 inch radius when wheel 145 includes the indicated characteristics.

The invention comprehends any reasonably sized diameter of radiused end for wheel 145 to effect the formation of initial openings 37, 118, as sizes and thicknesses of the tubular members from which finished blade 37 and its sheath 118 are to be made may vary.

The cam/guide assembly 72 and registry means 90 are machined out of aluminum block. The fixtures and other elements of the apparata described above are formed out of suitable and known metal elements well known in state-of-art machine shop practice.

Various changes and modifications may be made without departing from the spirit and scope of this invention, and the aim in the appended claims is to cover all such changes and modifications which fall within the true spirit and scope of the invention.

What we claim as patentably distinct is:

1. A method of forming a positive cutting angle across the thickness of a tubular wall forming a cutting edge about a compound oval opening in a tubular member having such wall and comprising the steps of (1) securing a fixture including a bore terminating at an end face for the fixture, (2) inserting into the fixture's bore a cylindrical unit comprising a spindle and a tubular member with such an opening in its tubular wall, at least the opening projecting outwardly of the fixture's face and having on the spindle a follower extending therefrom in an angular direction, (3) positioning a camming surface relative to such follower for cooperative engagement during subsequent grinding action on the cutting edge, (4) engaging the spindle's follower with the camming surface, (5) securing the spindle to the fixture, (6) setting the extent of the projection of the tubular member's compound oval opening, (7) registering the cutting edge about such opening in a proper position for subsequent grinding action thereon, (8) securing the tubular member to the spindle, (9) unsecuring the cylindrical unit from the fixture, and

(10) causing the follower to follow the camming surface during grinding action on the cutting edge forming the compound oval opening.

2. The method of claim 1 including the step of grinding the edge of the compound oval opening as the follower cooperates with the camming surface.

3. The grinding step of claim 2 wherein grinding occurs along a singular plane.

4. The method of claim 1 or claim 2 or claim 3 including the step of heat treating the tubular wall in which the compound oval opening is to be formed.

5. The method of claim 4 including the step of forming the initial compound oval opening in the wall of the tubular member.

6. The method of claim 1 or claim 2 or claim 3 including the step of forming the initial compound oval opening in the wall of the tubular member.

7. The method of claim 6 wherein the forming step comprises uniting the tubular member with a second tubular member and its tubular wall, clamping the tubular and second tubular members together, and pivoting a grinding element through the walls of the tubular and second tubular members.

8. The method of claim 4 including the steps of forming a tip member in which the compound oval opening is to be formed, and securing the tip member to the tubular member after the heat treating step is applied to the tip member but before the step forming the compound oval opening therein.

9. The method claim 5 including the steps of forming a tip member in which the compound oval opening is to be formed, and securing the tip member to the tubular member after the heat treating step is applied to the tip member but before the step forming the compound oval opening therein.

10. The method of claim 6 including the steps of forming a tip member is which the compound oval opening is to be formed, and securing the tip member to the tubular member after the heat treating step is applied to the tip member but before the step forming the compound oval opening therein.

11. The method of claim 7 including the steps of forming a tip member in which the compound oval opening is to be formed, and securing the tip member to the tubular member after the heat treating step is applied to the tip member but before the step forming the compound oval opening therein.

12. A cutting instrument having a positive cutting angle formed by the method of claim 1 or claim 2 or claim 3.

13. A cutting instrument having a positive cutting angle formed by the method of claim 4.

14. A cutting instrument having a positive cutting angle formed by the method of claim 6.

15. A cutting instrument having a positive cutting angle formed by the method of claim 7.

16. A cutting instrument having a positive cutting angle formed by the method of claim 8.

17. A cutting instrument having a positive cutting angle formed by the method of claim 9.

18. The instrument of claim 12 being a surgical cutting instrument.

19. The instrument of claim 13 being a surgical cutting instrument.

* * * * *